US008016011B2

(12) United States Patent
Ito et al.

(10) Patent No.: US 8,016,011 B2
(45) Date of Patent: Sep. 13, 2011

(54) LABELING APPARATUS

(75) Inventors: Daisuke Ito, Urayasu (JP); Toshiya Kobayashi, Tokyo (JP); Mitsugu Yamada, Chitose (JP)

(73) Assignee: Suntory Holdings Limited, Osaka-shi, Osaka (JP)

( * ) Notice: Subject to any disclaimer, the term of this patent is extended or adjusted under 35 U.S.C. 154(b) by 780 days.

(21) Appl. No.: 11/596,576

(22) PCT Filed: Apr. 21, 2006

(86) PCT No.: PCT/JP2006/308397

§ 371 (c)(1),
(2), (4) Date: Nov. 15, 2006

(87) PCT Pub. No.: WO2006/118049

PCT Pub. Date: Nov. 9, 2006

(65) Prior Publication Data

US 2007/0240828 A1 Oct. 18, 2007

(30) Foreign Application Priority Data

Apr. 27, 2005 (JP) ..... 2005-129725

(51) Int. Cl.
*B65C 9/08* (2006.01)

(52) U.S. Cl. ..... 156/570; 156/566

(58) Field of Classification Search ..... 156/568, 156/570, 566

See application file for complete search history.

(56) References Cited

U.S. PATENT DOCUMENTS

| | | | | | |
|---|---|---|---|---|---|
| 2,717,711 | A | * | 9/1955 | Banks | 118/231 |
| 2,931,691 | A | * | 4/1960 | Curtis et al. | 360/100.1 |
| 3,497,412 | A | * | 2/1970 | Koehn et al. | 156/364 |
| 3,886,026 | A | * | 5/1975 | Kienel | 156/361 |
| 4,108,710 | A | * | 8/1978 | Hoffmann | 156/450 |
| 4,655,871 | A | | 4/1987 | Mattei et al. | |
| 4,758,301 | A | * | 7/1988 | Inoko et al. | 156/361 |
| 4,999,649 | A | * | 3/1991 | Saji et al. | 346/134 |
| 5,447,262 | A | * | 9/1995 | Focke et al. | 226/87 |
| 6,045,616 | A | * | 4/2000 | Williamson et al. | 118/301 |
| 2007/0252886 | A1 | | 11/2007 | Sambongi et al. | |

FOREIGN PATENT DOCUMENTS

| | | | |
|---|---|---|---|
| JP | 59-209823 | | 11/1984 |
| JP | 60-45131 | | 3/1985 |
| JP | 61-12817 | | 4/1986 |
| JP | 61-12817 | | 10/1986 |
| JP | 62-052027 | A | 3/1987 |
| JP | 1-110115 | | 7/1989 |
| JP | 04-166971 | A | 6/1992 |
| JP | 7-19114 | | 4/1995 |
| JP | 2001-039420 | * | 2/2001 |
| JP | 2004-004441 | A | 1/2004 |
| JP | 2004-85651 | | 3/2004 |

* cited by examiner

*Primary Examiner* — Khanh Nguyen
*Assistant Examiner* — Vishal I Patel
(74) *Attorney, Agent, or Firm* — Drinker Biddle & Reath LLP

(57) ABSTRACT

An object of the present invention is to provide a labeling apparatus that allows a labeling operation to be carried out continuously for a long period without the need of cleaning, even if the easy-to-peel labels are used. To accomplish the above object, the present invention provides a conveying drum for correcting a position of a label applied with glue, while transferring the label. The conveying drum includes a predetermined groove extending circumferentially along an outer surface of the conveying drum.

6 Claims, 8 Drawing Sheets

LABELING APPARATUS

FIELD OF THE INVENTION

The present invention relates to a labeling apparatus for affixing a label including a content indication of a product to a product container and more particularly, to a labeling apparatus for affixing a label applied with thermally activated glue to a container such as a bottle.

THE RELATED ART

A commonly used labeling apparatus includes one as described below. Specifically, the labeling apparatus comprises a delivery roller for feeding a series of labels packaged in a roll serially one after another, a rotary cutter for cutting apart the series of labels fed from the delivery roller piece by piece, a leister for applying heat to the piece of cut label, and a conveying drum for transferring the piece of cut label through the leister to a predetermined label affixing position for a container such as bottle to which the label is to be affixed. In this regard, glue applied to the label is of thermally activated type, which can exhibit its adhesivity with the aid of the heat from the leister.

The labeling apparatus often includes a correction guide disposed at a location facing to an outer surface of the conveying drum for correcting the position of the label such that the label can be constantly affixed to a same area on the bottle of container. To explain the conveying drum and the correction guide in more detail, the conveying drum of conventional type has a disk-like configuration and comprises an aluminum material. The label is carried on a smooth outer surface of the conveying drum. In operation, the conveying drum is able to carry the label on the outer surface by suctioning air through a predetermined suction port formed in the outer surface of the conveying drum. In the region provided with the correction guide, the carrying power over the outer surface of the conveying drum can be removed temporarily by stopping or reducing the suction of the air from the suction port so as to allow the correction guide to correct the label position.

Specifically, the correction guide is provided in an arc configuration along a part of the outer surface of the conveying drum as seen in a plan view. Further, as seen in a vertical sectional view of FIG. 8, respective plate-like guide members 121 spaced apart from each other along the vertical direction are fixedly mounted as they are lying horizontally. In operation, the position of the label "L" is correctly adjusted by the guide member in one end portion thereof facing to the conveying drum 111. In the illustrated conventional system, the correction guide includes two main guide members 121*a* and 121*b* disposed in an upper and a lower ends and a plurality of auxiliary guide members 122 interposed between the main guide members 121*a* and 121*b*. The label L is transferred to a region between the main guide members 121*a* and 121*b*, where the position of the label L is corrected. During processing, the auxiliary guide members 122 can make correction so as to eliminate any bending or lifting of the label L. To do this, in the construction of the system, the end portions of the main guide members 121*a* and 121*b* are extending beyond the outer surface of the conveying drum 111 further into the conveying drum 111 side, while on the other hand each of the end portions of the auxiliary guide members 122 terminates at a position where it is retracted from the outer surface of the conveying drum 111 by a small distance (toward the left in the drawing).

When the labeling apparatus having such a configuration as described above is used to perform the labeling operation, the label L is typically transferred as it is sliding on the lower main guide member 121*b*.

The labeling apparatus typically includes one or two conveying drum(s). In the case of the labeling apparatus including only one conveying drum is used, the label is carried and transferred as it is suctioned against the conveying drum with an upper surface of the label, or the surface not applied with the glue but including an indication or printing indicative of a content indication and the like, in contact with outer surface of the conveying drum. Then, the adhesivity of the thermally activated glue can be activated with the aid of the leister to accomplish the affixing of the label to the bottle of container (When the single conveying drum is used, it is sometimes referred to as "an labeling drum").

If the system has employed two conveying drums, a first conveying drum (hereinafter referred to as a conveying drum 1) can transfer the label, as the label being suctioned against the conveying drum 1 with an under surface of the label, or the surface applied with the glue, in contact with the outer surface of the conveying drum 1, and hand over the label onto a second conveying drum (hereinafter referred to as a conveying drum 2; or sometimes as "the labeling drum") where the label is transferred under suction with the upper surface of the label in contact with the outer surface of the conveying drum 2 and then heated by the leister to accomplish the affixing of the label to the bottle of container. In this way of processing, a printing means may be optionally disposed circumferentially around the conveying drum 1 to provide the printing of a date of manufacture, an expiration date and the like information on the upper surface of the label.

SUMMARY OF THE INVENTION

Problem to be Solved by the Invention

The conventional type of labeling apparatus stated above has been suffered from problems as described below. Specifically, in the labeling apparatus equipped with the correction guide, there has been a problem that a contact region (121*b* of FIG. 8) between the correction guide and the labels would have an accumulation of adhering glue and/or scraps of paper of the label resulting from the sliding contact of the label with the correction guide over time as the number of transfer operation of the labels increases. The substance such as the glue adhering to the correction guide could inhibit the effective operation for correcting the label position, leading to erroneous positioning or, even worse, bad transfer of the label.

In such a labeling apparatus as having two conveying drums that includes the conveying drum specifically operable to suction the label with its glued surface in contact with the outer surface of the conveying drum, the conveying drum 1 having the outer surface made of aluminum material tends to create the accumulation of glue and/or scraps of paper over time in conjunction with the increased number of transfer operation of the labels. Problematically, the substance such as the glue adhering to the outer surface of the conveying drum could cause the labels to stick on the conveying drum, leading to bad transfer or inhibited position correcting operation.

To avoid those problematic situations, the labeling apparatus of the conventional system has been required to schedule a down time regularly for cleaning the apparatus, and this has inhibited any improvement in operating efficiency of the labeling apparatus.

On the other hand, a variety of thermally activated type labels have been recently developed, including easy-to-peel label, from the viewpoint directed to recycling of the bottles of containers. The easy-to-peel label tends to employ a softened glue, meaning that the adhesion of the glue or scraps of paper to the conveying drum or the correction guide is significant with the easy-to-peel labels. Especially, such a problem as pointed above is critical with the glue of thermally activated type whose hardness may also change depending on the temperature and/or humidity. Those problems have been disclosed in the prior art relating to the invention of the easy-to-peel label (see Japanese Patent Laid-open Publication No. 2004-85651, the SPECIFICATION, paragraph [0011]).

Means to Solve the Problem

The present invention has been made to overcome the above-pointed drawbacks in association with the labeling apparatus according to the prior art and an object thereof is to provide a labeling apparatus that allows the labeling operation to be carried out continuously for a long period without the need of cleaning, even if the easy-to-peel labels are used.

The inventors of the present invention have made an enthusiastic research to accomplish the above object and found that if the outer surface of the conveying drum defines an uneven surface but not a smooth surface, meaning that if a predetermined groove is formed extending circumferentially along the outer surface of the conveying drum, the contact area between the label and the conveying drum can be reduced and thus consequently the adhesion of the glue to the conveying drum can be reduced. In addition, the inventors have reached an idea that when the conveying drum having the uneven surface as described above, because of the fact that if the glue adheres to the conveying drum of such configuration, the glue tends to adhere only to a convex portion placed in contact with the labels, what is necessary is to provide a means for performing a cleaning operation exclusively and efficiently in the convex portion, and based on this idea, the inventors have constructed the apparatus equipped with a glue removing means (a plate) that is placed in contact with the convex portion of the outer surface of the conveying drum and later realized the fact that thus constructed apparatus allows to carry out the labeling operation continuously without applying regular cleaning to the conveying drum.

Further, the inventors have made a trial where a glue sweeper employed as a means that is operable automatically to remove the glue which would otherwise adhere to the correction guide is disposed at a predetermined location in the conveying drum with a part of the glue sweeper protruding from the conveying drum so that the glue sweeper can slidably move across the contact region between the correction guide and the label, and subsequently realized the fact that the glue would not accumulate over the correction guide owing to the glue sweeper that is always slidably moving on the correction guide to remove the glue.

The inventors have further found the fact that if the contact region between the correction guide and the label is configured by a rotor element of a cam follower structure, the contact area between the correction guide and the label can be reduced and thus the adhesion of the glue to the contact area can be reduced, and that a guide for transfer of the label provided by the rotor element reduces a sliding friction, leading to a successful reduction of the adhesion of the glue.

Ultimately, the inventors have accomplished the present invention based on their recognition with the use of a labeling apparatus equipped with the conveying drum and the correction guide as described above that the labeling operation can be carried out continuously for a long period without cleaning the labeling apparatus.

Specifically, the present invention relates to respective components and apparatus as described below:

(1) a conveying drum for transferring a label applied with glue, said conveying drum characterized by a predetermined groove extending circumferentially along an outer surface of the conveying drum;

(2) a conveying drum as defined in (1), characterized by a resin coat layer formed on the outer surface of the conveying drum;

(3) a labeling apparatus comprising a conveying drum as defined in (1) or (2) and further comprising a glue removing means that is placed in contact with the outer surface of the conveying drum at a surface area other than the area defining the groove;

(4) a labeling apparatus as defined in (3), in which the glue removing means includes a predetermined cut formed at a location corresponding to the groove;

(5) a labeling apparatus operable to correct a position of a label applied with glue, while transferring the label, the apparatus comprising a conveying drum and a correction guide in an arc configuration located facing to an outer surface of the conveying drum and extending circumferentially along a part of the outer surface of the conveying drum, the apparatus further characterized in that a glue sweeper is disposed in a predetermined location in the conveying drum with a part of the glue sweeper protruding from the conveying drum so that the glue sweeper can slidably move on the correction guide;

(6) a labeling apparatus operable to correct a position of a label applied with glue, while transferring the label, the apparatus comprising a conveying drum and a correction guide in an arc configuration located facing to an outer surface of the conveying drum and extending circumferentially along a part of the outer surface of the conveying drum, the apparatus further characterized in that a contact area of the correction guide with the label partially or entirely defines a curved configuration;

(7) a labeling apparatus operable to correct a position of a label applied with glue, while transferring the label, the apparatus comprising a conveying drum and a correction guide in an arc configuration located facing to an outer surface of the conveying drum and extending circumferentially along a part of the outer surface of the conveying drum, the apparatus further characterized in that a label transfer guide means for guiding a transfer operation of the label is disposed in a contact region of the correction guide with the label; and (8) a labeling apparatus as defined in (7), in which the label transfer guide means comprises a circular cylindrical rotor element extending partially or entirely along the arc of the correction guide.

Effect of the Invention

According to a labeling apparatus of the present invention, correcting of the label position and affixing of the label can be performed in a stable manner independently from each specific type of the label or property of the glue.

Figure 1:
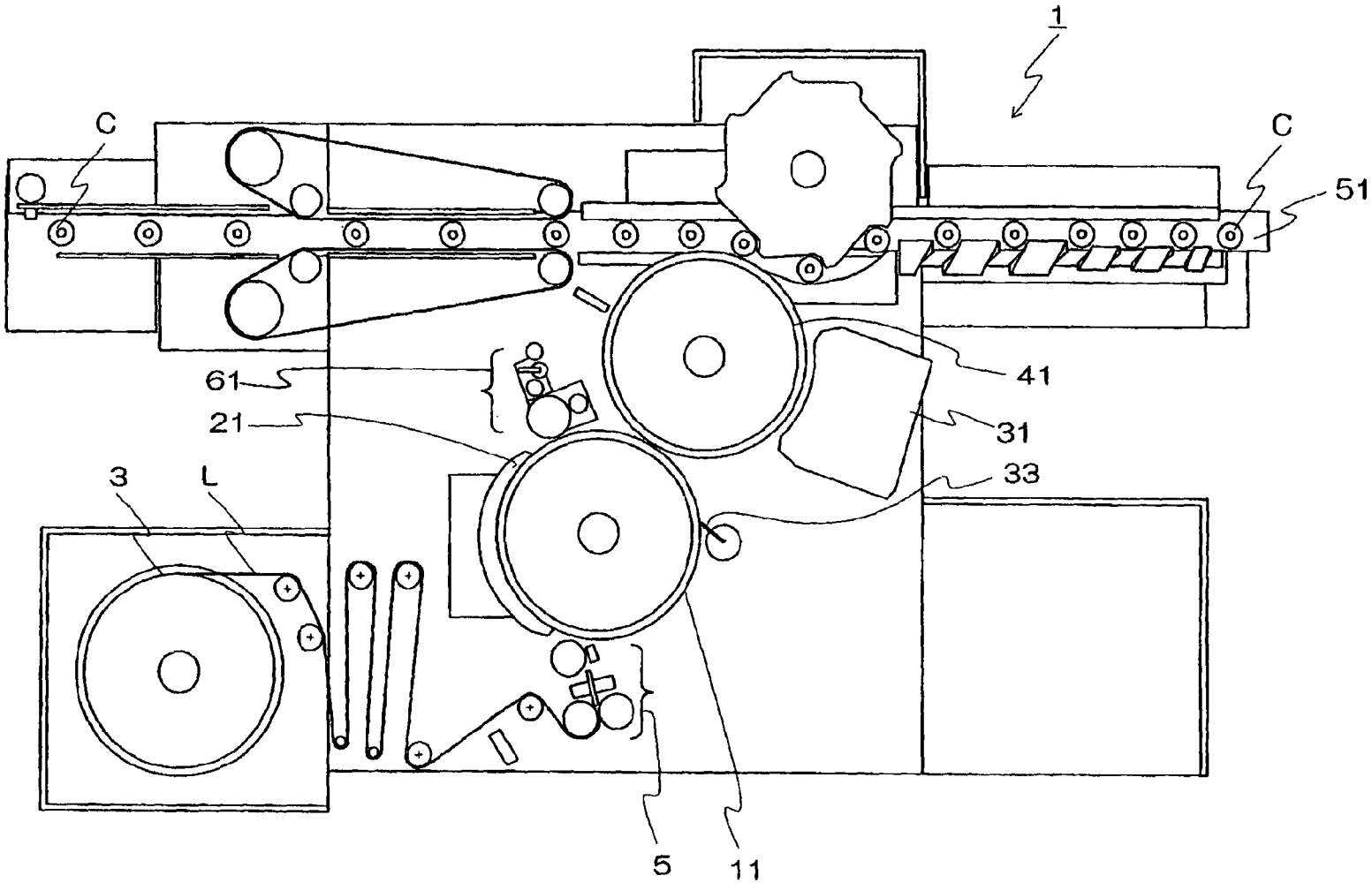
FIG. 1 is a plan view showing an overall configuration of a labeling apparatus according to the present invention.

| Description of reference numerals | |
|---|---|
| 1 | Labeling apparatus |
| 11 | Conveying drum |
| 12 | Glue sweeper |
| 13a, 13b | Groove |
| 14 | Convex portion |
| 15 | Suction port |
| 17 | Label stopper |
| 19 | Resin coat layer |
| 21 | Correction guide |
| 21a, 21b | Main guide member |
| 22 | Auxiliary guide member |
| 33 | Glue removing means |
| 41 | Labeling drum |
| 71a, 71b | Main guide member |
| 73 | Cam follower |
| L | Label |

BEST MODE FOR CARRYING OUT THE INVENTION

Conveying Drum

The present invention has employed a configuration of a conveying drum for transferring a label applied with glue, which includes a predetermined groove extending circumferentially along an outer surface of the conveying drum. If the conveying drum having such a configuration as described above is used, the label carried on the outer surface of the conveying drum is transferred in association with a rotation of the conveying drum. During being transferred, the label may come in contact with a convex portion but not with the groove in the outer surface of the conveying drum. This helps reduce a contact area between the label and the conveying drum and consequently adhesion of the glue to the conveying drum is reduced. Further advantageously, contact resistance between the label and the conveying drum is reduced, and this helps accomplish the correction of the label position much easily.

The number and the shape of groove formed in the outer surface of the conveying drum are not limited in nature but the groove may be designed appropriately so far as the label can be carried stably without causing any bending of the label over the outer surface of the drum. Disadvantageously, any forms of bending of the label could lead to bad transfer or inhibited position correcting operation. Preferably, the depth of the groove may be determined by taking rigidity of the label into account so that the groove is sufficiently deep to prevent the glue from adhering to a bottom of the groove (a concave portion) even if the label bends. In one example using a 50 mm long and 155 mm wide paper label, the illustrated conveying drum (FIG. 2) may include two grooves (concave portions), each having the width of 7 mm to 8.5 mm and the depth around 5 mm. It should be appreciated that a suction port formed in the outer surface of the conveying drum may be disposed exclusively in the convex portion, because the suction port, if provided in the groove (the concave portion), could cause the bending of the label.

Figure 3:
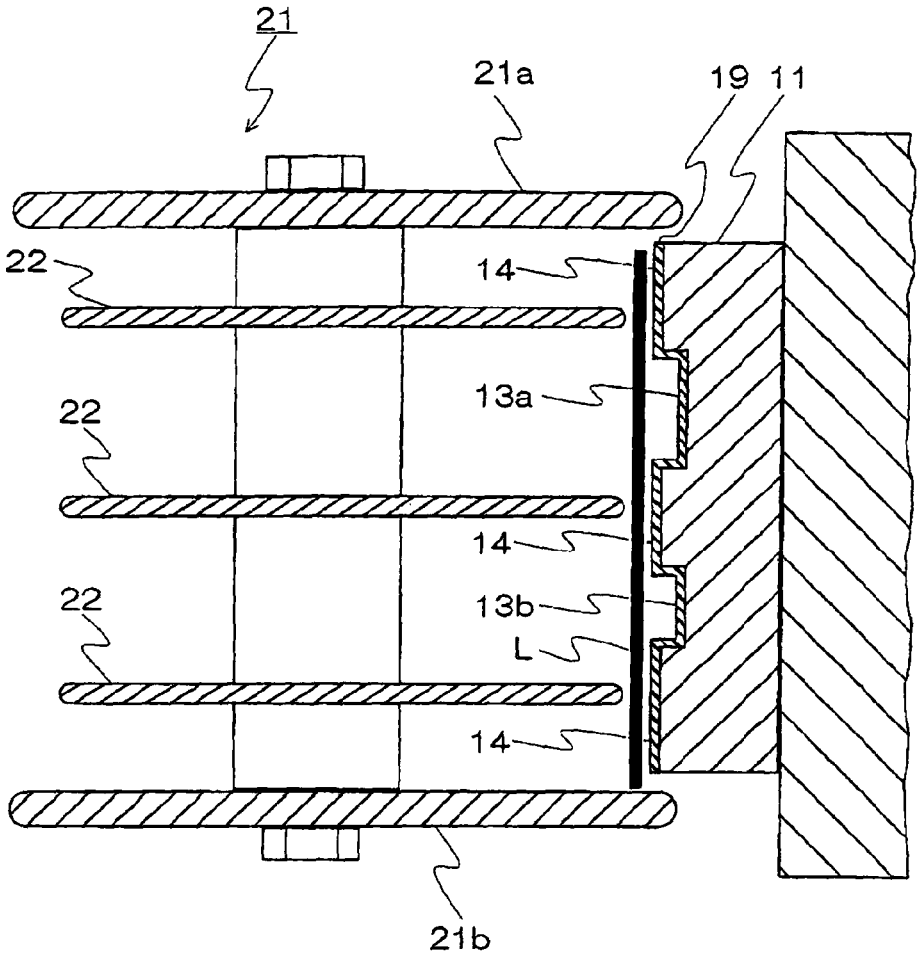
FIG. 3 is a sectional view taken along the line of FIG. 2.

If a predetermined resin coat layer is formed over the outer surface of the conveying drum described above, the adhesion of the glue to the conveying drum can be further inhibited (FIG. 3). Any resin materials may be used so far as they have a property for making it difficult for the glue to stick thereon, including, for example, Duracon, Solidur, MC nylon, New Light, vinyl chloride and Teflon. Preferably, the Teflon among others may be used by placing importance on its heat resisting property, because the conveying drum could be subject to a high temperature in some occasions where a leister is installed in the vicinity of the conveying drum.

[Glue Removing Means of the Conveying Drum]

A labeling apparatus according to the present invention has employed a configuration, in which the apparatus comprises the conveying drum and a glue removing means that is placed in contact with the outer surface of the conveying drum in a region other than said groove. When the labeling apparatus having the configuration as described above is used, the glue removing means is held in contact with the convex portion of the outer surface of the conveying drum constantly during the rotation of the conveying drum. Owing to this, any glue, if adhering to the convex portion of the outer surface of the conveying drum, can be removed immediately to keep the outer surface of the conveying drum clean. Although the labeling apparatus of the prior art comprises a glue removing device in the form of brush, the labeling apparatus of the present invention, in which the possible site of adhesion of the glue is limited to the convex portion of the outer surface of the conveying drum, may preferably comprise the glue removing means that can work efficiently to remove the glue adhering to the convex portion, the site of interest.

Although the shape of the glue removing means is not limited to specific one so far as it is capable of removing the glue or scraps of paper adhering to the conveying drum, preferably the glue removing means is not of brush type but of flat plate type because the latter can scrape off the glue and accordingly remove the glue more efficiently. The configuration of the labeling apparatus of the prior art requires the glue removing means of the type as described above to be installed in contact with an entire area of the outer surface of the conveying drum, but in that case, the installation of the glue removing means could be inhibited, due to the fact that greater friction between the outer surface of the conveying drum and the glue removing means could damage the conveying drum or break the glue removing means. In contrast, since the site of glue adhesion is limited to the convex portion in the outer surface of the conveying drum in the labeling apparatus of the present invention, meaning that the contact friction can be reduced, it is now allowable to install the glue removing device of the plate type usable for glue removing in the labeling apparatus. Although the glue removing means of plate type may be made of any material so far as it would not damage the conveying drum, including resin and rubber, preferably the one made of resin exhibiting a high glue removing effect may be used. Among others, specifically a resin having relatively high heat resisting property may be desirably selected for the use with the glue removing means installed in the vicinity of the leister. It should be appreciated that the glue removing means of plate type may be used in combination with the glue removing means of brush type.

Although the location where the glue removing means is installed is not particularly limited, preferably it may be installed in the vicinity of the leister or near a point immediately downstream to the site of label delivery where the label from the conveying drum is handed over onto the labeling drum. This is because the glue adhering to the conveying drum would have been softened with the aid of the heat from the leister and/or the labeling drum in the region as described above, facilitating the removal of the glue to improve the glue removing effect. It is further suggested that preferably the suction of air via the suction port of the conveying drum may be stopped near the site where the glue removing means has been installed. This is the arrangement for the purpose of preventing the glue that has been once removed is suctioned into the suction port. It is to be contemplated in order to prevent the suction of the removed glue into the suction port that the air is discharged from the suction port of the drum or a hot air blower may be provided. Further, a removed glue collecting device may be separately provided, which is serving to collect the glue or scraps of paper that have been once removed from the conveying drum by the glue removing device.

[Correction Guide]

A labeling apparatus according to the present invention has employed a configuration in which the labeling apparatus comprises a conveying drum and a correction guide in an arc configuration located facing to an outer surface of the conveying drum and extending circumferentially along a part of the outer surface of the conveying drum, and further comprises a glue sweeper disposed at a predetermined location in the conveying drum with a part of the glue sweeper protruding from the conveying drum so that the glue sweeper can slidably move on the correction guide. If the labeling apparatus having the configuration as described above is used, the glue sweeper is slidably moving on the correction guide to remove the glue constantly in association with the rotation of the conveying drum. This can eliminate the chance for the glue to accumulate over the correction guide.

The configuration of the glue sweeper is not limited in nature so far as it can work to remove the glue adhering to the top surface of the correction guide, such as plates or bars having different shapes, including, for example, a plate having a tip portion thereof protruding from the conveying drum defining a triangular, semi-circular, semi-elliptical or rectangular shape in a plan view. Although the material used to make the glue sweeper may be any one so far as it would not damage the correction guide, including the glue sweeper made of metal, resin, or rubber, preferably the one made of metal may be employed from the reason that a possible occasion where the leister is installed in the vicinity of the conveying drum and thus the glue sweeper is subject to the high temperature requires the material of the glue sweeper to have the heat resisting property. Most preferably, aluminum may be used, which is easy to process in manufacturing.

Preferably, the glue sweeper is installed at a location behind the label stopper. The glue sweeper, if provided at this location, would not interfere with the label being carried on the drum. It is further suggested from the viewpoint of cleaning or exchange of the glue sweeper that the glue sweeper is installed in the label stopper. The label stopper used herein defines a component serving for pushing a rear portion of the label in the transfer direction in order to transfer the label across the correction guide under the condition where the suction from the suction port of the conveying drum is stopped or reduced and the label stopper is made in the form of post extending along the bus line of the outer surface of the conveying drum. The glue sweeper may be secured to the label stopper by using a screw or may be integrally formed with the label stopper.

A labeling apparatus according to the present invention has further employed a configuration for another aspect of the correction guide as described below. Specifically, the labeling apparatus may comprise a conveying drum and a correction guide in an arc configuration located facing to an outer surface of the conveying drum and extending circumferentially along a part of the outer surface of the conveying drum, in which a contact area between the correction guide and the label partially or entirely defines a curved configuration. If the labeling apparatus having the configuration as described above is used, the contact area between the correction guide and the label can be reduced and thus the adhesion of the glue can be reduced. A geometry of the curved configuration specifically refers to the geometry with a resultantly reduced contact surface, including specifically folds and serration. In addition, a circular cylindrical rotor element may be employed, which will be described later.

In another aspect of the correction guide in a labeling apparatus according to the present invention, the labeling apparatus may employ a configuration in which a label transfer guide means is extending along a part of or a full length of the correction guide for guiding the label in transfer. If the labeling apparatus having the configuration as described above is used, the label transfer guide means can help reduce the sliding friction between the label and the correction guide or the contact area between the correction guide and the label, making it difficult for the glue of the label to adhere to the correction guide. The structure of the label guide means is not limited in nature so far as it is capable of reducing the sliding friction between the correction guide and the label, including, for example, the one comprising a plurality of circular cylindrical rotor elements partially or entirely across the contact region between the correction guide and the label or the one comprising a conveyer system, such as a belt, defining a part or all of the contact surface of the correction guide with the label.

The rotor element as described above may include a cam follower comprising a rotating wheel, a support shaft and a needle roller, a roller follower comprising an outer wheel, an inner wheel and a needle roller as well as a circular cylindrical bar capable of rotating. If any one of the above-described rotor elements is employed, the contact area between the correction guide and the label and thus the adhesion of the glue can be reduced. Further, if the rotor element is arranged so that it can rotate freely in response to the transfer speed of the label or it can rotate in synchronization with the transfer speed of the label, the sliding friction between the label and the correction guide can be reduced and so the adhesion of the glue to the correction guide can be suppressed. It is to be appreciated that the number and the material of the rotor elements may be determined appropriately. Preferably, the one comprising a circular cylindrical follower body with a coating layer of Teflon covering over the surface thereof may be used from the reason that the material of the above-described rotor element desirably has a property making it difficult for the glue to adhere as well as a property facilitating the removal of the glue once deposited thereon.

Preferred embodiments of the present invention will now be described in detail with reference to the attached drawings but the mode for carrying out the present invention is not limited to those illustrated herein.

FIG. 1 is a schematic diagram showing an overall configuration of a labeling apparatus 1 according to an embodiment of the present invention. The labeling apparatus 1 comprises a delivery roller 3 for feeding a series of labels "L" packaged in a roll sequentially one after another, a rotary cutter 5 for cutting apart the labels L fed from the delivery roller 3 piece by piece, a correction guide 21 for correcting a position of each cut label L so that the label L can be constantly placed in the right position and a leister 31 for applying heat to the correctly positioned label L. The labeling apparatus as shown in FIG. 1 comprises a conveying drum 11 located facing to the correction guide serving for correcting the position of the cut label L and a labeling drum 41 for passing the label nearby the leister 31 and then carrying out a labeling operation to affix the label L onto a bottle of container "C" and the like. In this regard, the bottle of container C onto which the label L is to be affixed is transferred to the vicinity of the labeling drum 41 by a conveyer 51. For the purpose of the present invention, glue applied to the Label L is of thermally activated type and its adhesivity can be activated by the heat from the leister 31.

Figure 2:
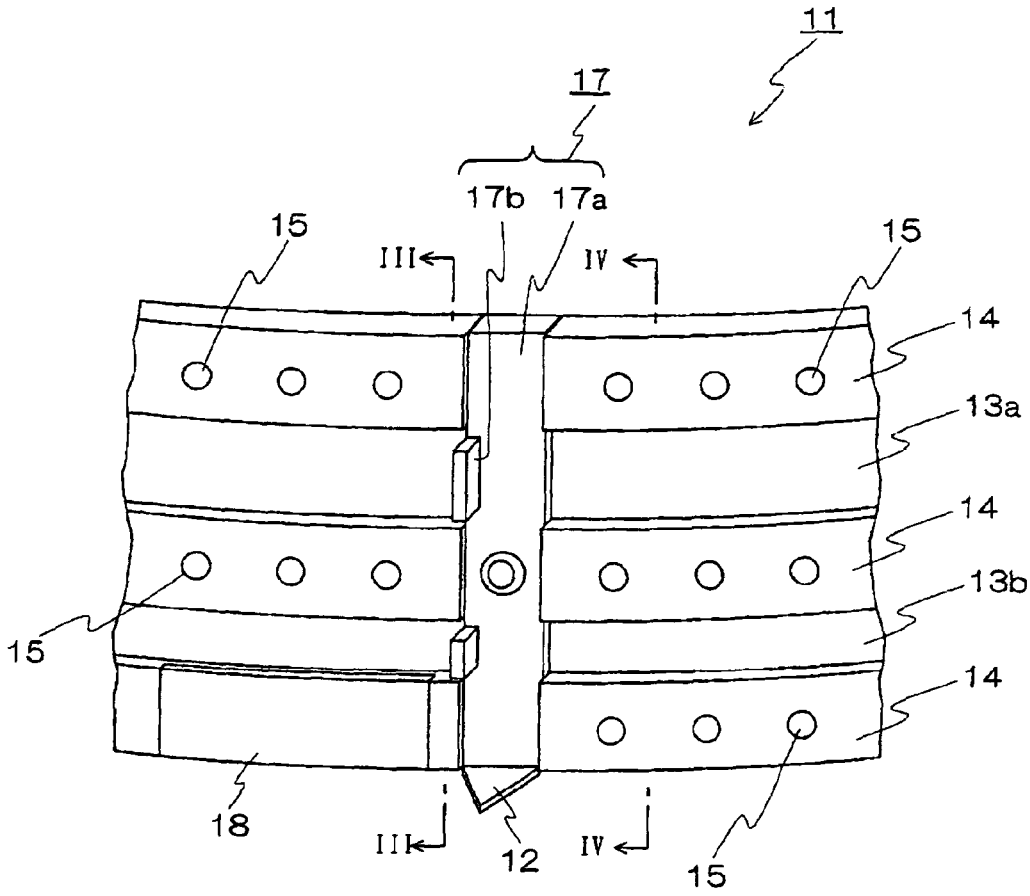
FIG. 2 is a perspective view showing a part of a conveying drum used in the labeling apparatus as disclosed in FIG. 1.
Figure 4:
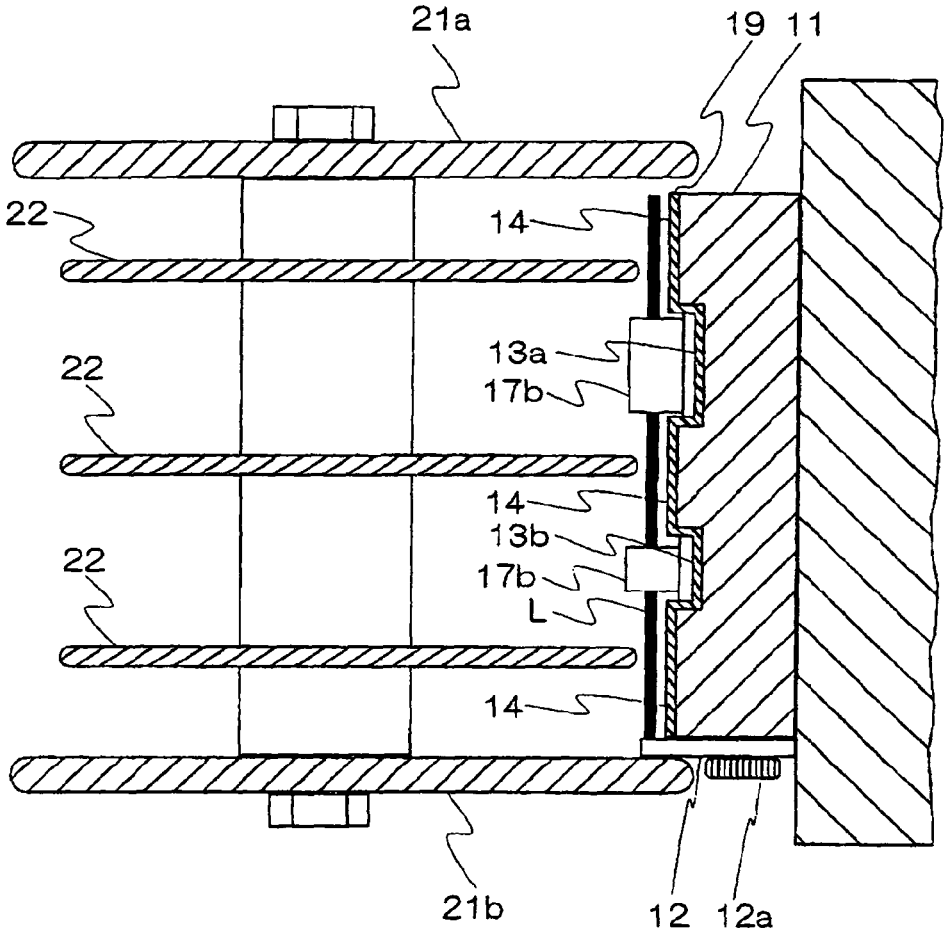
FIG. 4 is a sectional view taken along the IV-IV line of FIG. 2.

Referring to FIGS. 2 to 4, the conveying drum 11 representing a first drum of FIG. 1 is shown in an enlarged view, in which the conveying drum 11 of the present invention is shown to include a groove formed at a predetermined location in the outer surface of the conveying drum 11. Specifically, FIG. 2 is a perspective view showing a part of the outer surface of the conveying drum 11 and FIG. 3 is a sectional view taken along the line of FIG. 2. As shown in FIGS. 2 and 3, the outer surface of the conveying drum 11 defines an uneven surface of predetermined pattern. In the illustrated embodiment, two grooves 13*a* and 13*b* are formed circumferentially along the outer surface. In addition, the outer surface of the conveying drum 11 is applied with a resin coat layer 19 of Teflon as shown in FIG. 3.

As shown in FIG. 2, a plurality of suction ports 15 are formed in a convex portion 14 of the outer surface of the conveying drum 11. Those suction ports 15 are provided to carry the labels L in contact with the outer surface of the conveying drum 11, in which the conveying drum can carry the label L in contact with the outer surface of the conveying drum by suctioning air through the suction ports 15. In this connection, from the reason that if the suction ports 15 are formed in the groove 13*a*, 13*b*, the label L tends to bend, the suction ports are formed exclusively in the convex portion 14 to avoid the problem of bending of the label L.

Further, a predetermined label stopper 17 is securely provided in the outer surface of the conveying drum 11 as shown in FIGS. 2 and 4. The label stopper 17 is provided to push the label L so that the label L can be transferred in synchronization with the conveying drum 11 across the correction guide 21 under the condition where the suctioning of the air from the suction ports 15 is stopped or reduced. The label stopper 17 used in the illustrated embodiment comprises a member made of aluminum extending in the bus line direction of the outer surface of the conveying drum 11. Specifically, a predetermined longitudinal groove is formed along the bus line direction of the conveying drum 11, into which a stopper body 17*a* in the form of post is mounted securely. A stopper member 17*b* is provided on an upper surface of the stopper body 17*a* at a location corresponding to each of the grooves of the conveying drum 11, and the stopper member 17*b* ensures that the label L is properly transferred. In this connection, the reason why the stopper member 17*b* is disposed at the location corresponding to each of the grooves of the conveying drum 11 is to avoid a contact with a glue removing device serving to remove the glue in the concave portion of the conveying drum 11, which will be described later. It is to be appreciated that although only one label stopper 17 is shown in the drawings, actually a plurality of label stoppers 17 are fixedly mounted in the outer surface of the conveying drum 11.

In addition, a predetermined platen member 18 is disposed in the outer surface of the conveying drum 11 in the vicinity of the label stopper 17, as shown in FIG. 2. More specifically, the platen member 18 is arranged in the bottom row of the convex portions 14 of the conveying drum 11 on the left with respect to the label stopper 17. The platen member 18 is located in the area covered with the label L and serving as a platen in the printing on the label L by a printing machine 61. It is to be appreciated that the location of the platen member 18 is given by way of illustration only but the platen member 18 may be disposed in other locations.

Figure 5:
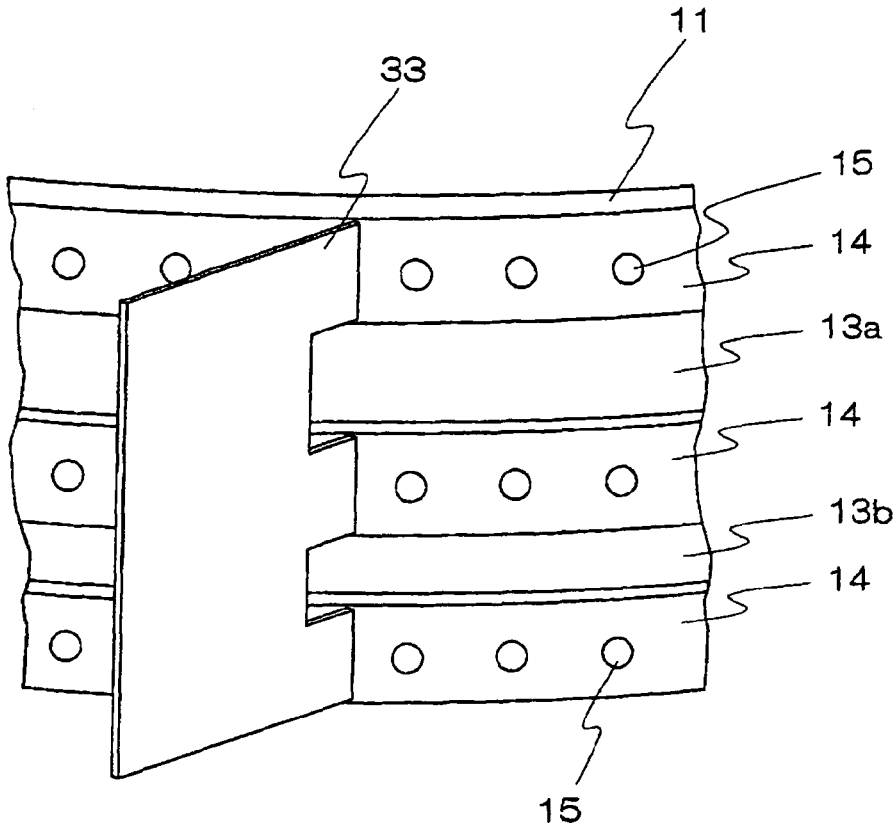
FIG. 5 is a perspective view showing a glue removing device according to the present invention.

The glue removing means 33 for the conveying drum 11 will now be described with reference to FIGS. 1 and 5. The glue removing means 33 is a plate member and disposed in the vicinity of the outer surface of the conveying drum 11 near the leister 31, as shown in FIG. 1. Specifically, the glue removing means 33 includes cuts defining concavities in regions corresponding to the respective grooves 13*a* and 13*b* in the outer surface of the conveying drum 11, as shown in FIG. 5. This configuration allows an edge portion of the glue removing means 33 to come into contact with the conveying drum 11 specifically in a region corresponding to each of the convex portions 14 but inhibits the contact with the concave portion 13*a*, 13*b* of the conveying drum 11. The reason why the glue removing means 33 is formed into the configuration as described above is both to remove the glue on the outer surface of the conveying drum 11 and to avoid the contact with the stopper member 17*b* as shown in FIGS. 1 and 4.

The correction guide 21 will now be described with reference to FIGS. 1 and 3. The correction guide 21 is disposed at a location facing to the outer surface of the conveying drum 11. Specifically, the correction guide 21 defines an arc extending along the outer surface of the conveying drum 11 as seen in a plan view. Further, if seen in a sectional view taken along the vertical direction, respective plate-like guide members 21*a*, 21*b* and 22 are spaced apart from each other in the vertical direction and fixed as extending horizontally, as shown in FIG. 3. They are operable to adjust the label L correctly in their ends facing to the conveying drum 11. The illustrated embodiment includes two main guide members 21*a* and 21*b* disposed in an upper and a lower ends and three auxiliary guide members 22 interposed therebetween. The label L may have its position corrected during being transferred, as the label L is held in position in the up and down direction between the respective guide members 21*a* and 21*b* and pushed by the stopper member 17*b* of the label stopper 17. In this stage, the auxiliary guide members 22 can work to eliminate any bending or lifting of the label L. To do so, the end portion of the main guide member 21*a*, 21*b* is extending beyond the outer surface of the conveying drum 11 further into the conveying drum 11 side, while on the other hand the end portion of the auxiliary guide member 22 terminates at the position where it is retracted from the outer surface of the conveying drum 11 by a small distance into the correction guide 21 side (toward the left in the drawing).

The glue sweeper 21 for the correction guide 21 will now be described with reference to FIGS. 2 and 4. The glue sweeper 12 is fixed to the under surface of the label stopper 17 with a screw 12*a* as shown in respective drawings. A tip portion of the glue sweeper 12 is configured to define a triangular shape as seen in a plan view and protrudes from the conveying drum 11 outward in the radial direction so as to come into contact with an upper surface of the lower main guide member 21*b*. Owing to this configuration, the glue sweeper 12 can slidably move on the upper surface of the main guide member 21*b*, as the conveying drum 11 rotates. The glue tends to adhere to the upper surface of the lower main guide member 21*b*, as the label L is carried in contact with it, while on the other hand the glue sweeper 21 can scrape off the glue adhering thereto to thereby eliminate the chance for the glue to accumulate thereon. It has been previously mentioned that the glue sweeper 12 is securely attached to the label stopper 17 with the screw 12*a* in the illustrated embodiment. When the glue sweeper 12 has worn out through a long-time operation, it can be exchanged easily to another by unfastening the screw 12*a*.

Figure 6:
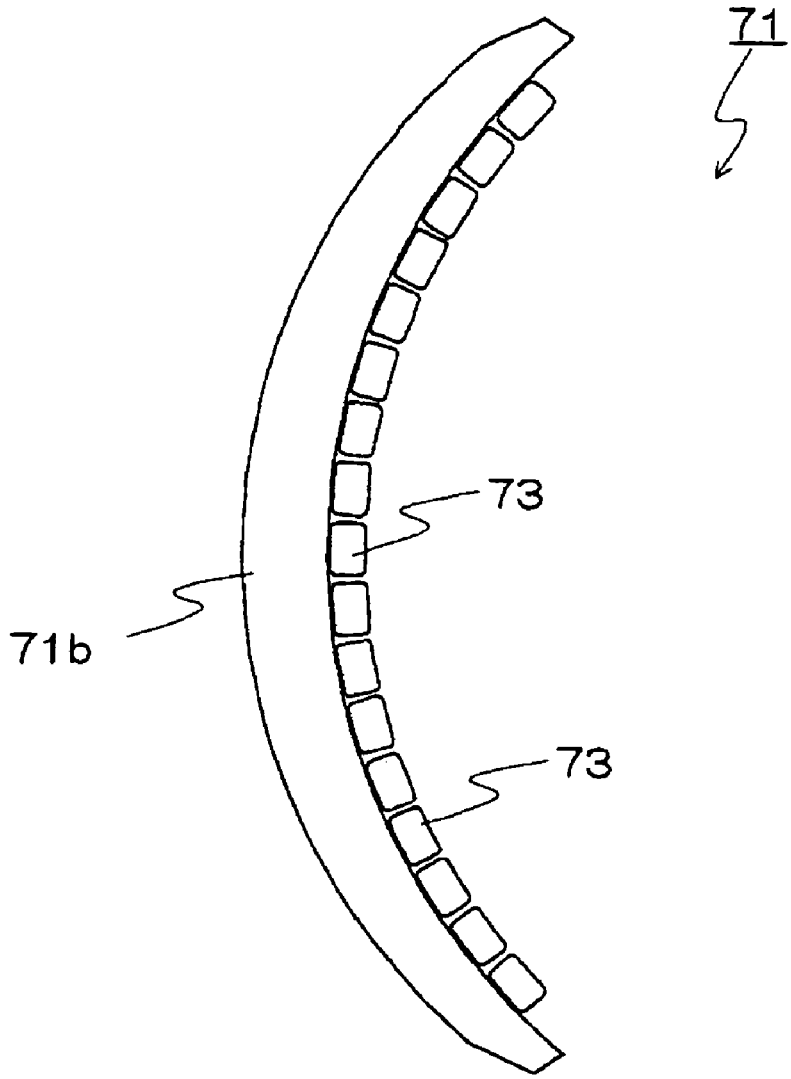
FIG. 6 is a plan view showing a main guide member according to a variation of a correction guide of the present invention.

Another embodiment of the correction guide will now be described with reference to FIGS. 6 and 7. A correction guide 71 according to the illustrated embodiment comprises numbers of cam followers disposed in a lower main guide member 71*b*. More specifically, the rotatable cam followers are arranged along the main guide member 71*b* formed in an arc configuration. A level of arrangement of a train of cam followers 73 corresponds to the position on which the label L is transferred.

Figure 7:
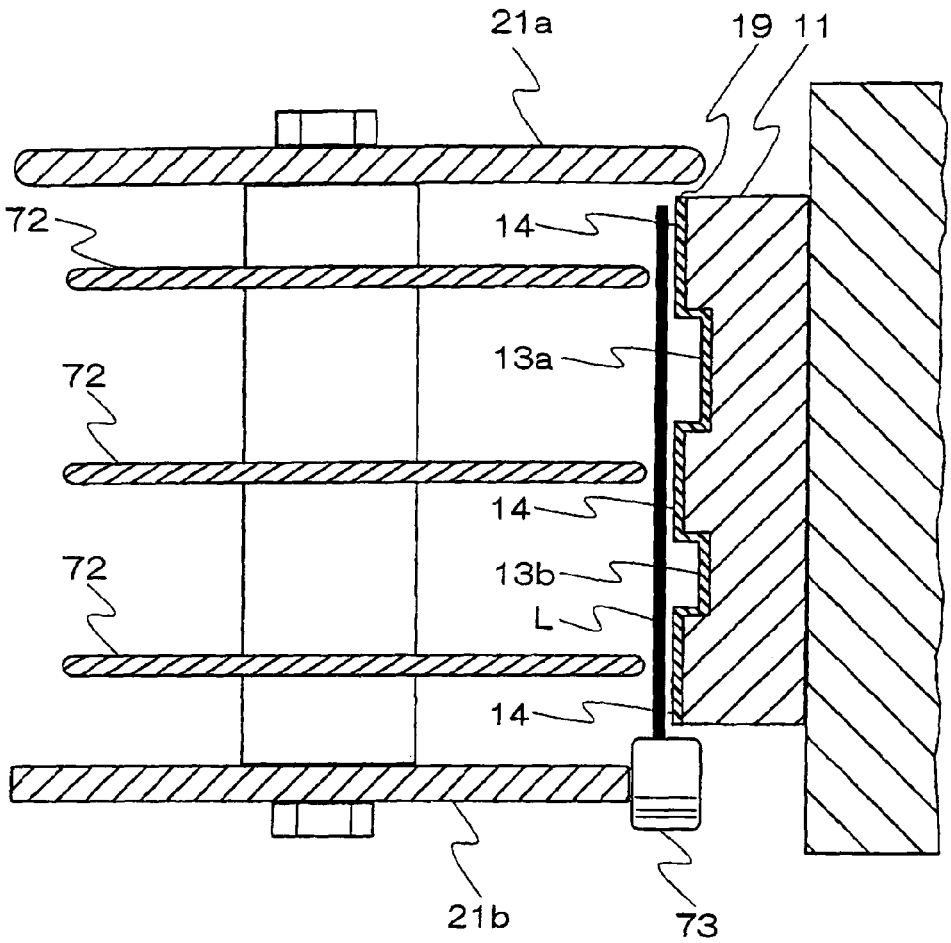
FIG. 7 is a sectional view of a correction guide equipped with the main guide member as disclosed in FIG. 6.
Figure 8:
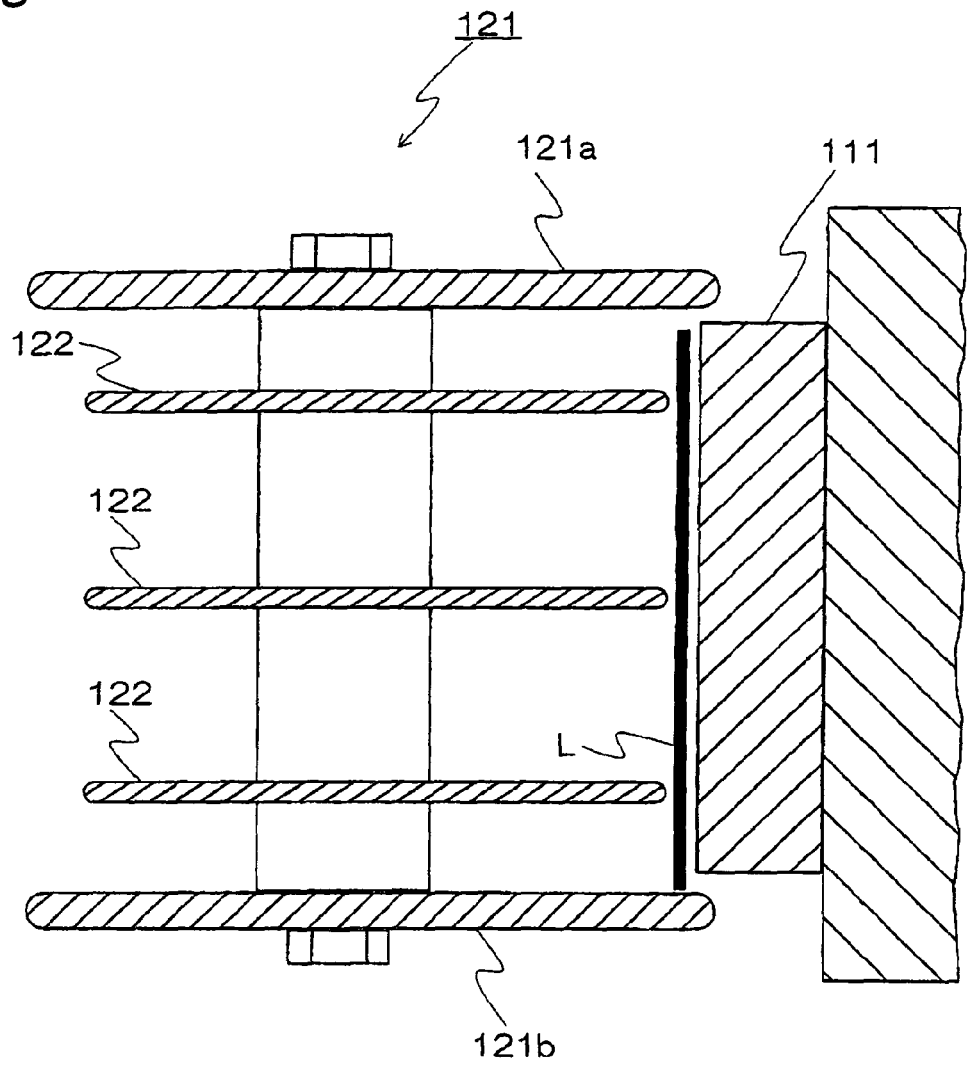
FIG. 8 is a sectional view showing a conveying drum and a correction guide of the prior art.

Since the label L is brought into contact with only upper ends of the cam followers 73, as shown in FIG. 7, the contact area can be extremely reduced as compared to the case of the main guide member 21*a* comprising the plate member (see FIG. 3). Consequently, this reduces the possibility of the glue adhesion to the surfaces of the cam followers. In addition, the cam follower 73 configured to rotate freely can rotate in itself when a sliding resistance (contact resistance) with the label L is high. It is to be appreciated that the cam followers may be forced to rotate at a predetermined rate so that the label L can be transferred at a rate of synchronized motion between the cam followers 73 and the conveying drum 11. Rotating the cam followers 73 in the manner as described above can extremely reduce the sliding resistance of the label L to thereby suppress the adhesion of the glue to the surfaces of the cam followers 73. There is still a possibility that a small amount of glue adheres to the surface of the cam follower 73 even with the employed configuration including the cam follower, and in that case, a brush (not shown) may be disposed below the cam follower 73 as desired so that the glue can be removed from the surface of the cam follower 73.

EXAMPLES

Example 1

A paper label of thermally activated type with a length of 50 mm and a width of 155 mm was affixed to a bottle of beverage container having a diameter of bottle section of Φ62.5 mm and a capacity of 210 ml by using a labeling apparatus as shown in FIGS. 1 to 5 (unit operation cycle: 6,100 c/s). A similar labeling operation was carried out by using a conventional labeling apparatus (having no groove in the conveying drum, no glue removing device for the drum and no glue sweeper for the correction guide) as a comparative example. It is to be noted that the conventional labeling apparatus was also of a type that was operable at the rate of 6,100 c/s.

Adhesion of the glue (white deposition) on the conveying drum and on the correction guide was visually recognized in the conventional labeling apparatus. The conventional labeling apparatus was subjected to the bad transfer and the bad sealing (displacement) condition at a high ratio, if no cleaning of the conveying drum and the correction guide was carried out by every 40 minutes. In contrast, in the labeling apparatus of the present invention, no deposition was visually observed on the conveying drum and on the correction guide after the labeling operating of 9 hours and 30 minutes.

The result shows that the conveying drum and the labeling apparatus of the present invention allows the labeling operation to be carried out in a stable manner for a long period without the need of cleaning.

Example 2

Labeling operation was conducted to affix a film label to a wine bottle by using the same labeling apparatus used in the example 1. The result from the case of the film bottle in the example 2 also shows that the labeling apparatus of the present invention allows the labeling operation to be carried out in a stable manner for a long period without the need of cleaning as with the case of the paper label.

INDUSTRIAL APPLICABILITY

The present invention is applicable to a labeling apparatus for transferring and affixing a label applied with glue to a surface of a bottle of container. It is to be appreciated that the present invention is not only applicable to the bottle of container but also to other types of containers, including a can of container.

The invention claimed is:

1. A labeling apparatus comprising:

a conveying drum for transferring a label applied with an adhesivity of a thermal activated glue on one surface of said label, said conveying drum including a predetermined groove with a depth based on a rigidity of the label and extending circumferentially along an outer surface of said conveying drum, and a suction port disposed substantially adjacent to the predetermined groove on the outer surface of said conveying drum, wherein a resin coat layer is formed on the outer surface of said conveying drum; and a glue removing means that is placed in contact with an area of the outer surface of said conveying drum that includes the suction port that is substantially adjacent an area defining said groove.

2. A labeling apparatus claimed in claim 1, in which said glue removing means includes a predetermined cut formed at a location corresponding to said groove.

3. A labeling apparatus operable to correct a position of a label applied with an adhesivity of a thermal activated glue, while transferring said label, said apparatus comprising:

a conveying drum, a correction guide in an arc configuration located facing an outer surface of said conveying drum and extending circumferentially along a part of the outer surface of said conveying drum, said correction guide including a main guide member that extends from at least one of an upper end and a lower end of said correction guide, and a glue sweeper disposed in a predetermined location in said conveying drum with a part of said glue sweeper protruding from said conveying drum so that said glue sweeper slidably moves on the main guide member of said correction guide.

4. A labeling apparatus operable to correct a position of a label applied with an adhesivity of a thermal activated glue, while transferring said label, said apparatus comprising:

a conveying drum having a groove and a convex portion, a correction guide in an arc configuration located facing an outer surface of said conveying drum and extending circumferentially along a part of the outer surface of said conveying drum, and a glue removing means that is placed in contact with the convex portion of said conveying drum, wherein a contact area of said correction guide with said label partially or entirely defines a curved configuration.

5. A labeling apparatus operable to correct a position of a label applied with an adhesivity of a thermal activated glue, while transferring said label, said apparatus comprising:

a conveying drum having a groove and a convex portion, a correction guide in an arc configuration located facing an outer surface of said conveying drum and extending circumferentially along a part of the outer surface of said conveying drum, said correction guide including a main guide member that extends from an end of said correction guide, a glue removing means that is placed in contact with the convex portion of said conveying drum, and a label transfer guide means for guiding a transfer operation of said label disposed at the main guide member of said correction guide and disposed in a contact region of said correction guide with said label.

6. A labeling apparatus claimed in claim 5, in which said label transfer guide means comprises a plurality of rotatable cam followers having cylindrical shape disposed partially or entirely along said arc of said correction guide.

* * * * *